US009284172B2

(12) United States Patent
Ishikawa

(10) Patent No.: US 9,284,172 B2
(45) Date of Patent: Mar. 15, 2016

(54) MANUAL CHAIN BLOCK

(75) Inventor: Kazumitsu Ishikawa, Nakakoma-gun (JP)

(73) Assignee: Kito Corporation, Yamanashi (JP)

( * ) Notice: Subject to any disclaimer, the term of this patent is extended or adjusted under 35 U.S.C. 154(b) by 358 days.

(21) Appl. No.: 13/634,845

(22) PCT Filed: Mar. 16, 2011

(86) PCT No.: PCT/JP2011/057060
§ 371 (c)(1),
(2), (4) Date: Sep. 13, 2012

(87) PCT Pub. No.: WO2011/118666
PCT Pub. Date: Sep. 29, 2011

(65) Prior Publication Data

US 2013/0001489 A1 Jan. 3, 2013

(30) Foreign Application Priority Data

Mar. 25, 2010 (JP) ..... 2010-069912

(51) Int. Cl.
*B66D 3/16* (2006.01)

(52) U.S. Cl.
CPC ..... *B66D 3/16* (2013.01)

(58) Field of Classification Search
CPC ..... B66D 1/02; B66D 1/04; B66D 1/14; B66D 3/12; B66D 3/14; B66D 3/16
USPC ..... 254/341–344
See application file for complete search history.

(56) References Cited

U.S. PATENT DOCUMENTS 3,894,720 A * 7/1975 Koji ..... 254/342
5,566,925 A * 10/1996 Wada et al. ..... 254/358
6,588,731 B2 7/2003 Nakamura et al.

FOREIGN PATENT DOCUMENTS

| | | |
|---|---|---|
| JP | 57-59223 | 4/1982 |
| JP | 58-89682 | 6/1983 |
| JP | 58-161989 | 10/1983 |
| JP | 59-195193 | 12/1984 |
| JP | 2004-168454 | 6/2004 |

OTHER PUBLICATIONS

English translation of JP 2004-168454 A.*

(Continued)

*Primary Examiner* — Sang Kim
*Assistant Examiner* — Nathaniel Adams
(74) *Attorney, Agent, or Firm* — Lewis Roca Rothgerber Christie LLP

(57) ABSTRACT

Disclosed is a manual chain block that achieves a more compact overall device and also does not lose the strength of the device itself by means of the position of a reduction gear of a speed reduction mechanism section being able to be positioned closer to the center regardless of the bearing of a load sheave. In the manual chain block, a load sheave (12) is supported rotatably by a first and second primary frame (11*a*, 11*b*) by means of bearings (13*a*, 13*b*) with axle sections (12*a*, 12*b*) therebetween. A supplemental plate (30)—which forms, in the direction of thrust: a bearing hole (33) of an axle section (16*br*) of a first reduction gear (16*b*); and a drawn section (31)—is, in a manner so as to supplement the aforementioned first primary frame (11*a*), disposed at the periphery of the bearing (13*a*) that supports the axle section (12*a*) of the load sheave (12) at the first primary frame (11*a*).

5 Claims, 6 Drawing Sheets

(56) References Cited

OTHER PUBLICATIONS

International Search Report of corresponding PCT/JP2011/057060, dated Jul. 5, 2011, 4 pages.

Office action issued on Aug. 27, 2013 in corresponding Japanese Patent Application No. 2010-069912 including English translation, 4pp. (showing relevance of JP 58-161989 and JP 59-195193 listed above).

* cited by examiner

MANUAL CHAIN BLOCK

CROSS-REFERENCE TO RELATED APPLICATION(S)

This application is a National Phase Patent Application and claims priority to and benefit of International Application Number PCT/JP2011/057060, filed on Mar. 16, 2011, which claims priority to and benefit of Japanese Patent Application Number 2010-069912, filed on Mar. 25, 2010, the entire disclosure of which are incorporated herein by reference.

FIELD OF THE INVENTION

The present invention relates to a manual chain block, and in particular to a manual chain block in which an arrangement of a reduction gear mechanism is redesigned to achieve further size reduction and weight reduction while ensuring adequate strength.

BACKGROUND ART

A manual chain block used for a load lifting operation has been conventionally known, which includes a chain block main body, an upper hook for suspending the chain block main body, a load chain looped around a load sheave of the chain block main body, a lower hook connected to a lower end of the load chain, and a hand chain looped around a hand wheel. The hand chain includes, for example, an endless chain, an endless belt or an endless rope, and has a function of transmitting operational force of an operator to the hand wheel. Similarly, the hand wheel is engaged with the endless chain, the endless belt or the endless rope to convert the operational force of the operator into rotational force.

An exemplary configuration of a manual chin block as described above is disclosed in JP 59-195193 U, for example.

As shown in FIG. 6, a manual chain block 1 has a pair of frames 2*a* and 2*b* opposed to each other with a predetermined spacing therebetween. Between these frames 2*a* and 2*b*, a base shaft 4 of a load sheave 3 is rotatably supported by bearings 4B. A drive shaft 5 is rotatably supported in a center hole 4*a* of the base shaft 4. A reduction gear mechanism 6 is interposed between the drive shaft 5 and the load sheave 3 such that rotational power of the drive shaft 5 is transmitted to the load sheave 3 at a decreased speed, in order to wind the load chain up and down.

The reduction gear mechanism 6 includes a pinion gear 6*a* provided at one end of the drive shaft 5, two first reduction gears 6*b* and 6*b* which mesh with the pinion gear 6*a*, second reduction gears 6*d* and 6*d* provided on gear shafts 6*c* and 6*c* of the first reduction gears 6*b* and 6*b*, and a load gear 6*e* which meshes with the second reduction gears 6*d* and 6*d*. In this case, in order to support the gear shafts 6*c* and 6*c* of the first reduction gears 6*b* and 6*b*, a bearing 6*f* is provided on the frame 2*a* at a position radially outside of the bearing 4B for supporting the base shaft 4 of the load sheave 3.

The drive shaft 5 has a threaded portion 7 on the other end of the drive shaft 5 opposite to the pinion gear 6*a*. A mechanical brake 9 with a hand wheel 8 is screwed onto the threaded portion 7.

SUMMARY OF THE INVENTION

Problem to be Solved by the Invention

However, in the manual chain block as described above, the distances between axes of the first reduction gears 6*b* and 6*b* and of the pinion gear 6*a*, and between axes of the second reduction gears 6*d* and 6*d* and the load gear 6*e* are large, resulting in an increased diameter of each gear. In addition, because of the bearings 4B for supporting the base shaft 4 of the load sheave 3 and of the bearing 6*f* for supporting the gear shafts 6*c* and 6*c* of the first reduction gears 6*b* and 6*b*, the shaft of each reduction gear is prevented from being positioned closer to a central axis of the drive shaft 5. This prevents size reduction of the manual chain block 1.

The present invention is proposed to overcome the above-described problem, and has the object of providing a manual chain block that allows a reduction gear of a reduction gear mechanism to be positioned on an inner side of the apparatus, irrespective of an outer shape of a bearing of a load sheave, in order to achieve size reduction of the overall apparatus without impairing the strength of the apparatus.

Means for Solving the Problem

In order to achieve the above-described object, a manual chain block is provided as defined in Claim 1, the manual chain block including a drive shaft capable of rotating in response to a manual operational force, and a load sheave around which a load chain is looped, the load sheave being mounted coaxially to the drive shaft, supported together with the drive shaft on a frame via a bearing and coupled to the drive shaft so that mechanical power is transmitted therebetween, via a reduction gear mechanism, wherein the reduction gear mechanism includes a pinion gear provided on the drive shaft, reduction gears which mesh with the pinion gear, and a load gear which is interlocked with the load sheave and meshes with the reduction gears, and wherein the manual chain block further includes an auxiliary plate mounted on a side surface of the frame and in the periphery of the bearing, the auxiliary plate including a stepped portion formed in a thrust direction of the bearing and having a bearing hole which serves as a bearing for the reduction gear.

With the above manual chain block, a conventional bearing for the reduction gears can be omitted. Therefore, even if the bearing for supporting the load sheave on the frame is a roller bearing having a large diameter, the shaft of the reduction gear can be positioned closer to the center despite the presence of such a bearing. This allows the reduction gear mechanism to occupy only a smaller space. The auxiliary plate can also bear force acting on the reduction gears and thrust force acting on the bearing for supporting the load sheave by means of the stepped portion of the auxiliary plate.

In accordance with the invention as defined in Claim 2, the auxiliary plate has a draw portion formed by drawing so as to be spaced apart over a predetermined distance from a surface of the frame on which the auxiliary plate is mounted, a center hole formed in a center of the draw portion, and a bearing hole formed in the vicinity of the center hole and projecting toward the surface of the frame on which the auxiliary plate is mounted, so as to serve as a bearing for the reduction gear.

With the above manual chain block, the shaft of the reduction gear is supported by the bearing hole projecting toward the surface of the frame onto which the auxiliary plate is mounted. This allows the auxiliary plate to be a thin plate made of steel, for example.

In accordance with the invention as defined in Claim 3, the bearing hole is formed in a tubular portion projecting toward the frame by means of burring.

With the above manual chain block, when the auxiliary plate is mounted onto the frame, the tubular portion defining the bearing hole abuts to the surface of the frame onto which the auxiliary plate is mounted, so that thrust force from the reduction gear acting on the bearing hole is transmitted to and is borne by the frame. Therefore, the thickness of the auxiliary plate can be reduced.

In accordance with the invention as defined in Claim 4, the manual chain block has a fixing hole for fixing the auxiliary plate by means of a rivet, the fixing hole being formed in the auxiliary plate in the vicinity of an outside of an outer edge of the draw portion.

With the above fixing hole, the auxiliary plate can be easily attached to the frame, while misalignment of the auxiliary plate is prevented.

In accordance with the invention as defined in Claim 5, the tubular portion of the bearing hole of the auxiliary plate situated closer to the center hole is positioned so as to come in contact with a side surface of the bearing.

With the above manual chain block, not only can the shaft of the reduction gear be positioned closer to the center, but force in a thrust direction acting on the bearing of the load sheave is borne by the tubular portion of the bearing hole of the auxiliary plate situated closer to the center. This eliminates a need for a thrust stop ring used for the bearing for supporting the load sheave.

In accordance with the present invention, by means of an auxiliary plate having a stepped portion and defining a bearing hole which substitutes an ordinary bearing, which is usually used, the ordinary bearing for the gear shaft can be dispensed with in order to form a reduction gear mechanism. As a result, irrespective of the bearing for the load sheave, the gear shaft of the reduction gear mechanism can be positioned closer to the center. Accordingly, the overall size of the apparatus can be further reduced. In addition, since the stepped portion can bear force in a thrust direction or the like, the auxiliary plate and the frame can be thinner.

EMBODIMENT FOR CARRYING OUT THE INVENTION

Various embodiments of a manual chain block according to the present invention will be described below with reference to appended drawings.

First Embodiment

Figure 1:
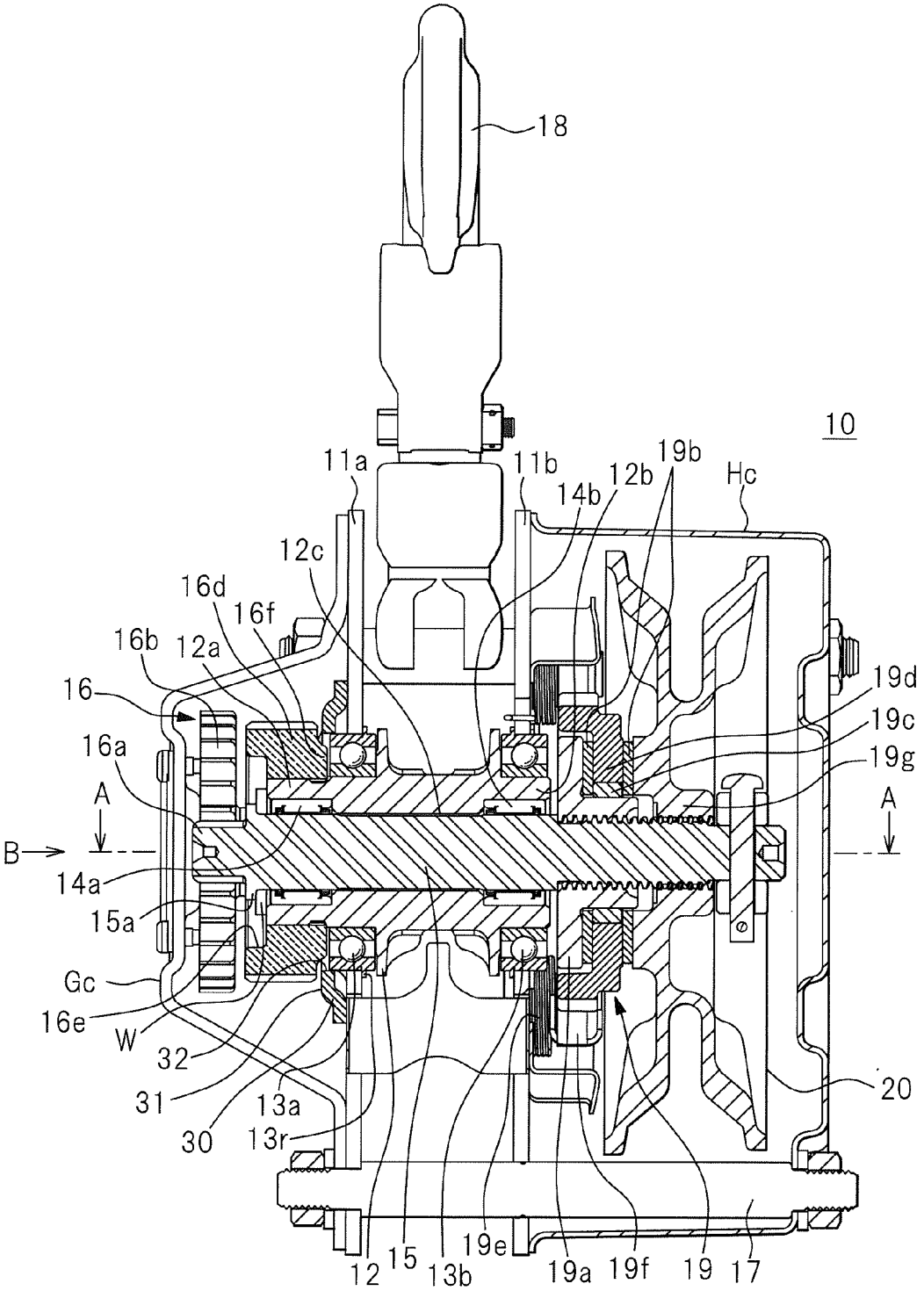
FIG. 1 is a longitudinal sectional view showing a manual chain block according to a first embodiment of the present invention.
Figure 2:
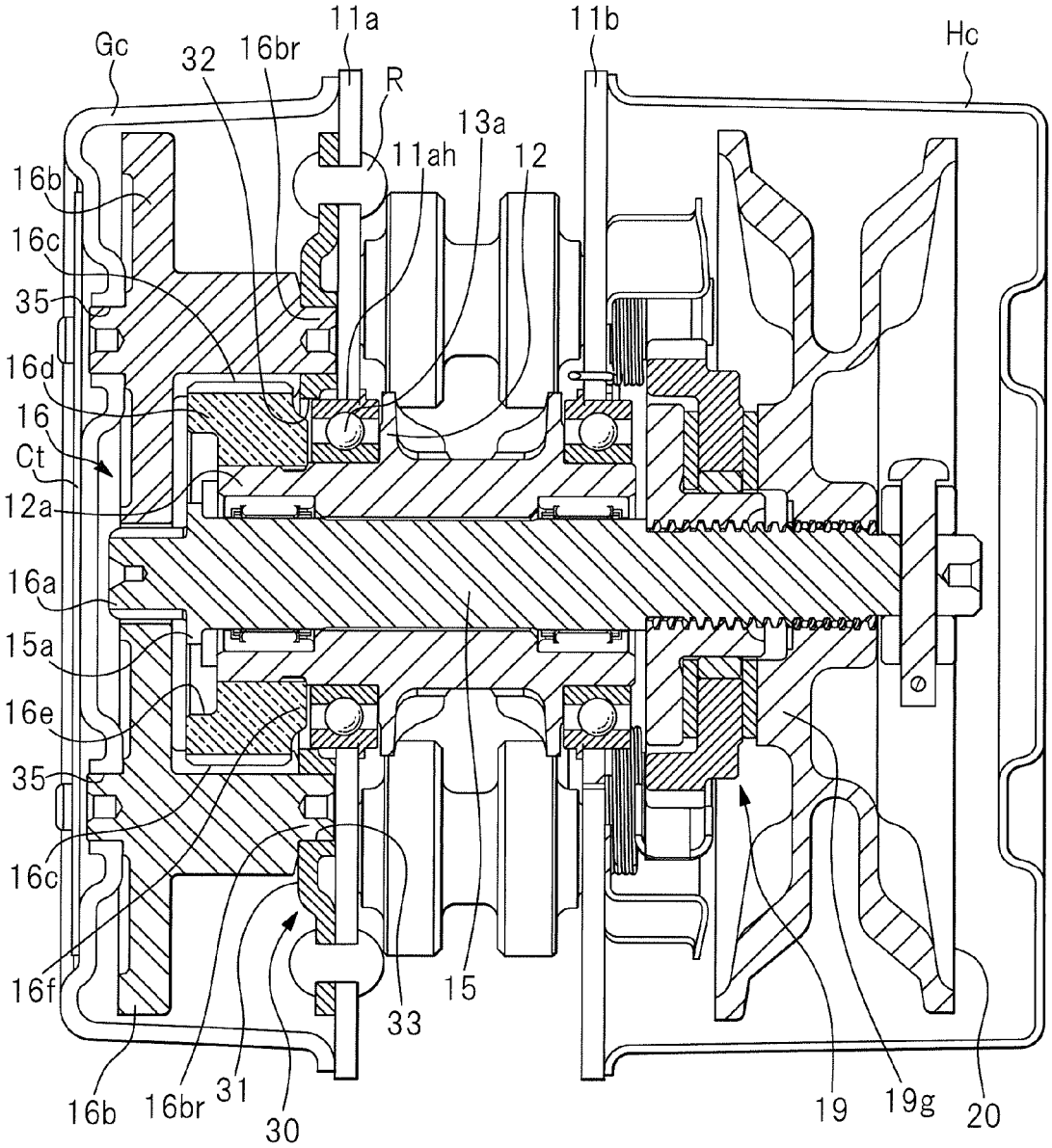
FIG. 2 is a transverse sectional view showing the manual chain block, taken along line A-A shown in FIG. 1.

FIGS. 1 and 2 show a manual chain block 10 according to a first embodiment.

The manual chain block 10 includes a first and a second main frames 11*a* and 11*b* disposed opposite to each other at a predetermined distance, and a load sheave 12 rotatably supported on the first and the second main frames 11*a* and 11*b* with bearings (ball bearings) 13*a* and 13*b* interposed therebetween. The load sheave 12 is supported by the bearings 13*a* and 13*b* at shaft portions 12*a* and 12*b*.

In the manual chain block 10, a drive shaft 15 extends in a through-hole 12*c* extending through a central axis of the shaft portion 12*a* and 12*b* of the load sheave 12. The drive shaft 15 is supported so as to be rotatable relative to the load sheave 12 via needle bearings 14*a* and 14*b*.

A reduction gear mechanism 16 is interposed between the drive shaft 15 and the load sheave 12, and rotational power output of the drive shaft 15 is transmitted to the load sheave 12 at a decreased speed.

A gear cover Gc for housing the reduction gear mechanism 16 and a wheel cover Hc for housing a mechanical brake 19 and a hand wheel 20, which will be described below, are interconnected to each other and held by the first and the second main frames 11*a* and 11*b* by means of three stud bolts 17. Further, an upper hook 18 is pivotally attached to the first and the second main frames 11*a* and 11*b* by means of a shaft (not shown) fixed to an upper part of the first and the second main frames 11*a* and 11*b*.

In the drawing, the reduction gear mechanism 16 is situated at the end of the left side of the drive shaft 15 which projects from the shaft portion 12*a* of the load sheave 12 toward the left side of the first main frame 11*a*. On the other hand, a thread (multiple thread) with relatively large lead extends to an axial end of the drive shaft 15 at the end of the right side of the drive shaft 15 which projects from the shaft portion 12*b* of the load sheave 12 toward the right side of the second frame 11*b*. The mechanical brake 19 provided with a hand wheel 20 is attached to the axial end of the drive shaft 15.

The mechanical brake 19 includes a driven member 19*a*, a pair of brake members 19*b* and 19*b* interposed in the outer periphery of a boss portion of the driven member 19*a*, a ratchet gear 19*d* interposed between the brake members 19*b* and 19*b* via a bush 19*c*, a claw member 19*f* biased by a torsion spring 19*e* provided at the second main frame 11*b* so as to mesh with the ratchet gear 19*d* and prevent the ratchet gear 19*d* from rotating in a direction to wind down, and a drive member 19*g* integrally provided with a hand wheel 20 in the outer periphery thereof.

An endless chain (not shown) is looped around the hand wheel 20 for transmitting operational force by an operator to the hand wheel 20. When the hand wheel 20 undergoes positive rotation by a hand chain, the drive member 19*g* is moved on the multiple thread of the drive shaft 15 so as to be pressed against the brake member 19*b* of the mechanical brake 19, and the hand wheel 20 and the drive shaft 15 are coupled together so that mechanical power is transmitted therebetween. As a result, rotational power of the hand wheel 20 when winding up is transmitted to the drive shaft 15. On the other hand, when the hand wheel 20 undergoes reverse rotation, the drive member 19*g* releases the brake member 19*b* and the ratchet gear 19*d* which have been pressed against each other, terminating the braking action. As a result, the drive shaft 15 is able to rotate in the direction to wind down.

Next, the reduction gear mechanism 16 situated on the left end side of the drive shaft 15 will be described.

Figure 3:
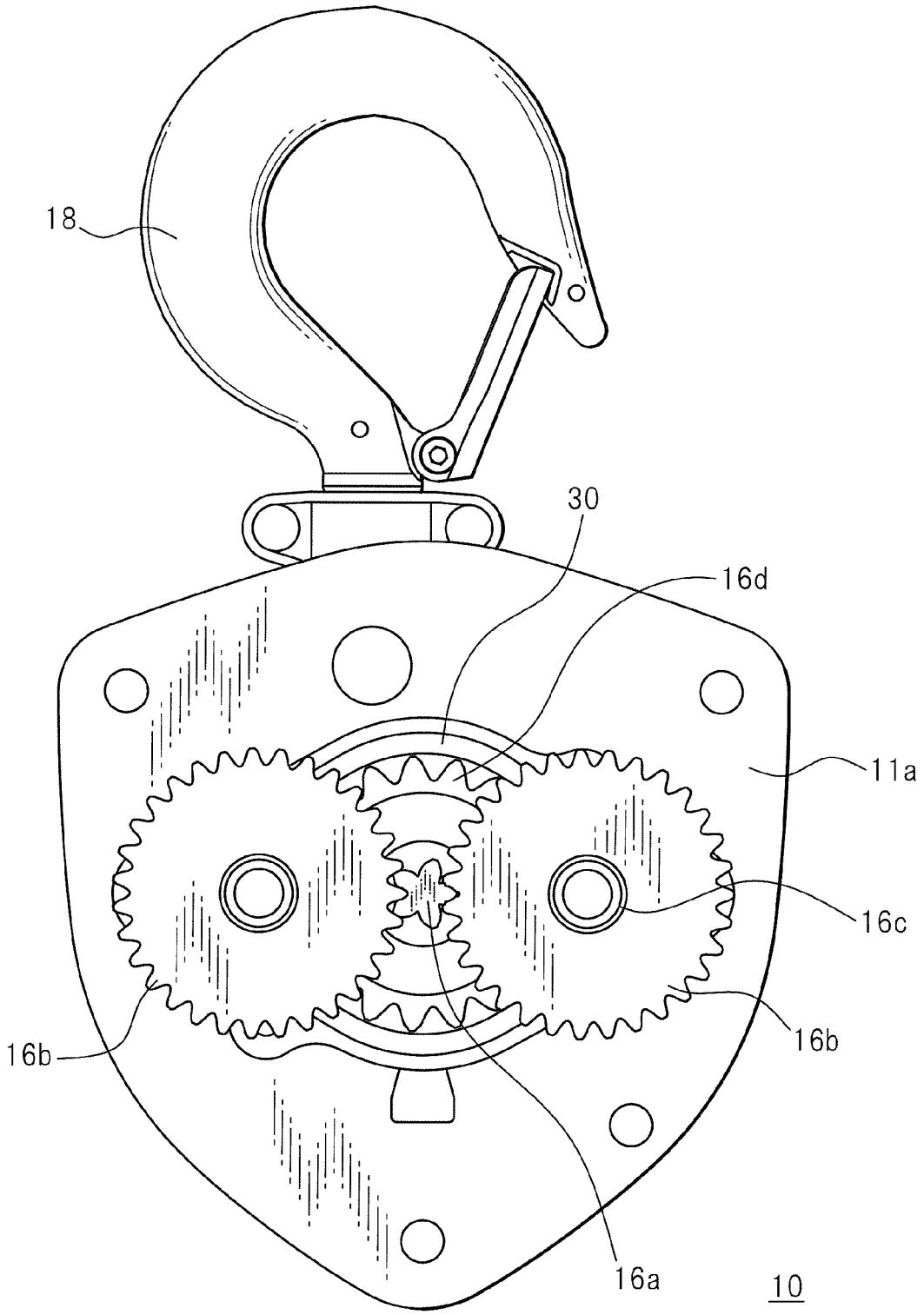
FIG. 3 is a side view showing the manual chain block, seen from direction B shown in FIG. 1.

Referring also to FIG. 3, the reduction gear mechanism 16 has a pinion gear 16*a* provided on the drive shaft 15, and a pair of first reduction gears 16*b* and 16*b* which mesh with the pinion gear 16*a*.

The pinion gear 16*a* is a small gear having a toothed portion at the axial end of the drive shaft 15. The drive shaft 15 has a flange portion 15*a* adjacent to the pinion gear 16*a* and the flange portion 15*a* has a larger diameter as compared to the diameter of the shaft. A washer W is situated between the flange portion 15*a* and a portion projecting from the shaft portion 12*a* of the load sheave 12 to function as a stopper in a thrust direction.

The pinion gear 16*a* meshes with the pair of the first reduction gears 16*b* and 16*b*, respectively, at a first stage of predetermined reduction ratio. The pair of the first reduction gears 16*b* and 16*b* are opposed to each other in a horizontal direction with the pinion gear 16*a* positioned at their center. In this case, as will be described below, the shaft portions of the pair of the first reduction gears 16*b* and 16*b* are supported by an end face of the gear cover Gc opposed to the axial end of the drive shaft 15 and by an auxiliary plate mounted onto the first main frame 11*a*, which will be described below.

Referring to FIG. 2, the reduction gear mechanism 16 has a pair of second reduction gears 16*c* and 16*c* provided on the shaft portions of the pair of the first reduction gears 16*b*, 16*b*, and a load gear 16*d* which meshes with the pair of the second reduction gears 16*c* and 16*c* at a second stage of predetermined reduction ratio.

The load gear 16*d* is fitted onto the outer circumferential surface of the shaft portion 12*a* of the load sheave 12, and is held by means of a spline connection. The load gear 16*d* has a recess 16*e* in the center of the left end side thereof. The flange portion 15*a* is situated in the recess 16*e* and the end face of the load gear 16*d* on the left side is made flush with the flange portion 15*a*. A boss portion 16*f* is situated in the center of the load gear 16*d* on the opposite side of the recess 16*e* and bulges toward the bearing 13*a*. The boss portion 16*f* has a smaller diameter than the outer diameter of the load gear 16*d*. The boss portion 16*f* is inserted to a center hole 32 of an auxiliary plate 30, which will be described below, so as to extend in the center hole 32. The load gear 16*d* is positioned by a stepped portion of the shaft portion 12*a*.

The auxiliary plate 30 is situated in the circumference of the bearing 13*a* of the first main frame 11*a* for supporting the shaft portion 12*a* of the load sheave 12. The auxiliary plate 30 is provided so as to be mounted on the side surface of the first main frame 11*a*. The auxiliary plate 30 is processed so as to be plastically deformed and form a stepped portion in a thrust direction.

In order to prepare the auxiliary plate 30, a draw portion 31 is formed by means of drawing, for example, such that its center portion is spaced apart from the end surface of the first main frame 11*a* over a predetermined distance. Then, the draw portion 31 is perforated, with the draw portion 31 as the center, to form a center hole 32 to which the bearing 13*a* can be fitted with the outer circumference of the bearing 13*a* in contact therewith.

The bearings 13*a* and 13*b* for rotatably supporting the load sheave 12 via the shaft portions 12*a* and 12*b* abut to a projecting portion of the load sheave 12 which projects in the form of a flange inside the opposing first and second main frames 11*a* and 11*b*. A stop ring 13*r* is provided on the bearings 13*a* and 13*b* in order to hold the bearings 13*a* and 13*b* against force applied by the load sheave 12 in a thrust direction.

Figure 4A:
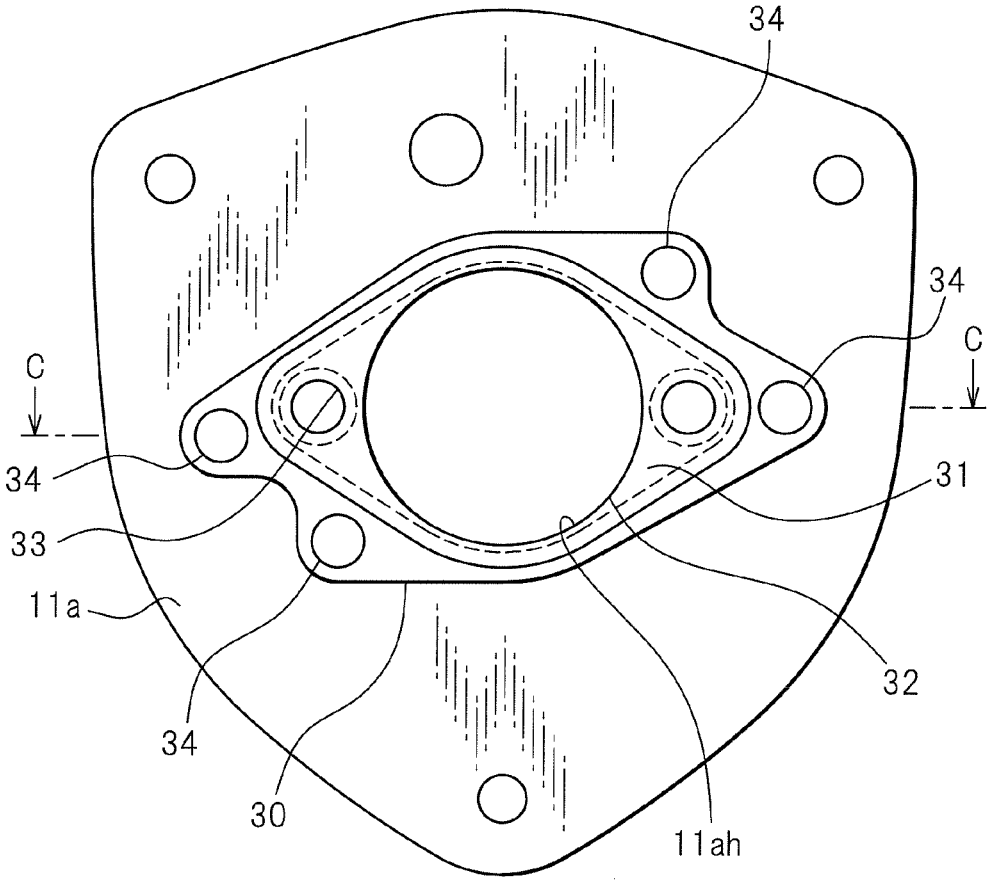
FIG. 4*a* is a plan view showing an arrangement of an assembly of a first main frame of the manual chain block shown in FIG. 1 and of an auxiliary plate mounted onto the first main frame.
Figure 4B:
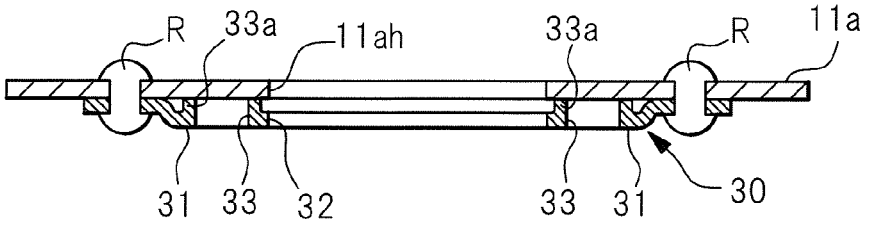
FIG. 4*b* is a sectional view showing the first main frame and a holding plate, taken along line C-C shown in FIG. 4*a;*

With also reference to FIGS. 4*a* and 4*b*, the auxiliary plate 30 mounted to the first main frame 11*a* will be described in detail below.

The first main frame 11*a* has an insertion hole 11*ah* through which the shaft portion 12*a* of the load sheave 12 is inserted via the bearing 13*a*. The auxiliary plate 30 is positioned by means of a shaft-like positioning jig fitted to the center hole 32 and the insertion hole 11*ah* such that a center of the center hole 32 of the auxiliary plate 30 coincides with that of the insertion hole 11*ah*. The auxiliary plate 30 is fixed to the first main frame 11*a* by means of rivets R.

Therefore, if the positioning jig has such a shaft diameter portion fitted to the center hole 32 and the insertion hole 11*ah*, the center hole 32 needs not coincide with the insertion hole 11*ah*. Yet if the center hole 32 coincides with the insertion hole 11*ah* as shown in FIGS. 1 and 2, it is easy to position the center hole 32 and the insertion hole 11*ah* relative to each other, and the center hole 32 and the insertion hole 11*ah* can be spaced apart to support the outer circumference of the bearing 13*a* over a greater area. As a result, the bearing 13*a* can be firmly supported.

Accordingly, the auxiliary plate 30 is provided with the draw portion 31 formed by means of drawing, for example, so as to separate a center portion of a steel plate material from the end surface of the first main frame 11*a* over a predetermined distance, as described above. The draw portion 31 has a bottom generally having a flat rhombus shape with rounded corners. Thereafter, the draw portion 31 is perforated at its center to form the center hole 32. Bearing holes 33 for the shaft portions 16*br* of the first reduction gears 16*b* are simultaneously formed by means of burring, for example, on both sides with the center hole 32 interposed therebetween. The bearing holes 33 are formed at equal distance from the center of the center hole 32 and on the longer diagonal line of the bottom rhombus of the draw portion 31. Further, two or more fixing holes 34 are formed near the outer edge of the draw portion 31 in order to fix the auxiliary plate 30 to the first main frame 11*a* with the rivets R.

The center of the auxiliary plate 30 is positioned relative to the first main frame 11*a* by means of the center hole 32 and the insertion hole 11*ah*. The auxiliary plate 30 has an embossed portion (half punched portion, not shown) in the vicinity of the fixing hole 34, and the embossed portion can be fitted to a positioning hole (not shown) of the first main frame 11*a* for positioning the center hole 32 in the circumferential direction. With the aid of the positioning hole and the embossed portion, the auxiliary plate 30 is positioned and fixed to the first main frame 11*a* with the rivets R. Tubular portions 33*a* of the bearing holes 33 of the auxiliary plate 30 are preferably held in close contact with the first main frame 11*a*.

The auxiliary plate 30 as described above is subjected to predetermined heat treatment (hardening or the like) before fixed to the first main frame 11*a*. The auxiliary plate 30 serves as a bearing by being fixed to the first main frame 11*a*, while it also serves as an enforcing member for preventing the first main frame 11*a* from being deformed in the thrust direction by means of the draw portion 31.

The axial end of the left end side of the first reduction gear 16*b* is supported by the bearing hole 35 formed, by means of burring, at a portion of the gear cover Gc opposed to the axial end of the drive shaft 15. A cover end plate Ct is attached to the outer side of the bearing hole 35, and certain grease is filled in the inner space of the gear cover Gc to ensure lubrication of each gear and bearing.

The configuration of the manual chain block 10 according to the first embodiment has been described above. An operation and function of the manual chain block 10 will be now described.

When the hand wheel 20 undergoes positive rotation as the hand chain (not shown) is operated, the drive member 19*g* of the hand wheel 20 is moved on the multiple thread of the drive shaft 15 to come in contact with the brake member 19*b* of the mechanical brake 19 and tighten the brake member 19 and the like. As a result, the driven member 19*a* and the drive shaft 15 are coupled together so that mechanical power is transmitted therebetween, and rotational force of the hand wheel 20 is transmitted to the drive shaft 15.

On the other hand, when the hand wheel 20 undergoes rotation in a direction opposite to the above-described rotation, the drive member 19*g* of the hand wheel 20 is moved on the multiple thread of the drive shaft 15 away from the brake member 19*b* of the mechanical brake 19. As a result, the braking action of the mechanical brake 19 is terminated, and the drive shaft 15 is then able to rotate together with the hand wheel 20 in the direction to wind down. The load chain looped around the load sheave 12 is simultaneously wound down and a lower hook (not shown) for hanging a load can be lowered to the position of the load.

When the load is hooked to the lower hook and the hand wheel 20 undergoes positive rotation, the drive member 19*g* of the hand wheel 20 is moved on the multiple thread of the drive shaft 15 to come in contact with the brake member 19*b* of the mechanical brake 19 and tighten the brake member 19*b* and the like. As a result, the driven member 19*a* and the drive shaft 15 are coupled together so that mechanical power is transmitted therebetween, and rotational force of the hand wheel 20 is transmitted to the drive shaft 15. Accordingly, the load sheave 12 is rotated via the reduction gear mechanism 16 at a predetermined speed reduction ratio so as to wind the load up by the load chain.

When rotational force of the hand wheel 20 is transmitted to the drive shaft 15, the rotational force is transmitted at a predetermined first speed reduction ratio from the pinion gear 16*a* at the axial end of the drive shaft 15 to the pair of the first reduction gears 16*b* and 16*b* opposed to each other in a horizontal direction with the pinion gear 16*a* situated as a center thereof.

The pair of the first reduction gears 16*b* and 16*b* can be rotated with the bearing hole 35 of the gear cover Gc functioning as a bearing for the axial end on the left end side and with the bearing hole 33 near the center hole 32 of the auxiliary plate 30 functioning as a bearing on the right end side of the shaft portion 16*br*.

The rotational force transmitted through the first stage of reduction ratio is transmitted to the load gear 16*d* at a second stage of reduction ratio through the second reduction gear 16*c* integrally formed on the shaft portion of the first reduction gears 16*b* and 16*b*. The rotational force is then transmitted to the load sheave 12 which is in a spline connection with the load gear 16*d*. In this way, the load gear 16*d* and the load sheave 12 are rotated together.

As described above, the lateral surface of the toothed portion of the reduction gear 16*c* is opposed to the draw portion 31 of the auxiliary plate 30 mounted around the bearing 13*a*, so as to come into contact with the draw portion 31. As a result, force of the reduction gear 16*c* in a thrust direction and a radial direction produced when the reduction gear 16*c* is rotated together with the load sheave 12 is borne by the draw portion 31 of the auxiliary plate 30.

The draw portion 31 of the auxiliary plate 30 is formed so as to be spaced apart from the end surface of the first main frame 11*a* over a predetermined distance. Further, the auxiliary plate 30 has been subjected to certain heat treatment. In addition, the tubular portion 33*a* of the bearing hole 33 of the auxiliary plate 30 is held in close contact with the first main frame 11*a*. In this way, the force of the reduction gear 16*c* in a thrust direction is borne by the first main frame 11*a* via the tubular portion 33*a*, and therefore, the auxiliary plate 30 can be reduced in wall thickness.

As described above, in the manual chain block 10, in order to provide the pair of the first reduction gears 16*b* and 16*b* that may give rise to a problem relating to a space in the reduction gear mechanism 16, the bearing holes 35 and 33 obtained by processing the gear cover Gc and the auxiliary plate can be used as bearings in place of ordinary bearings.

Specifically, since the bearing hole 33 of the auxiliary plate 30 is formed in the proximity of the center hole 32 and adjacent to the bearing 13*a* for supporting the shaft portion 12*a* of the load sheave 12, the shaft of the reduction gear can be positioned as close to the center as possible. Such a configuration contributes to miniaturization of the manual chain block 10.

In addition, the auxiliary plate 30 is held in close contact with the first main frame 11*a* via the tubular portion 33*a* of the bearing hole 33 with the center hole 32 of the draw portion 31 interposed therebetween, and therefore, the first main frame 11*a* and the auxiliary plate 30 form the composite structure. As a result, force is exerted on the load sheave 12 and the reduction gear in a distributed manner, so that the first main frame 11*a* and the auxiliary plate 30 can be made in reduced thickness.

Second Embodiment

Figure 5:
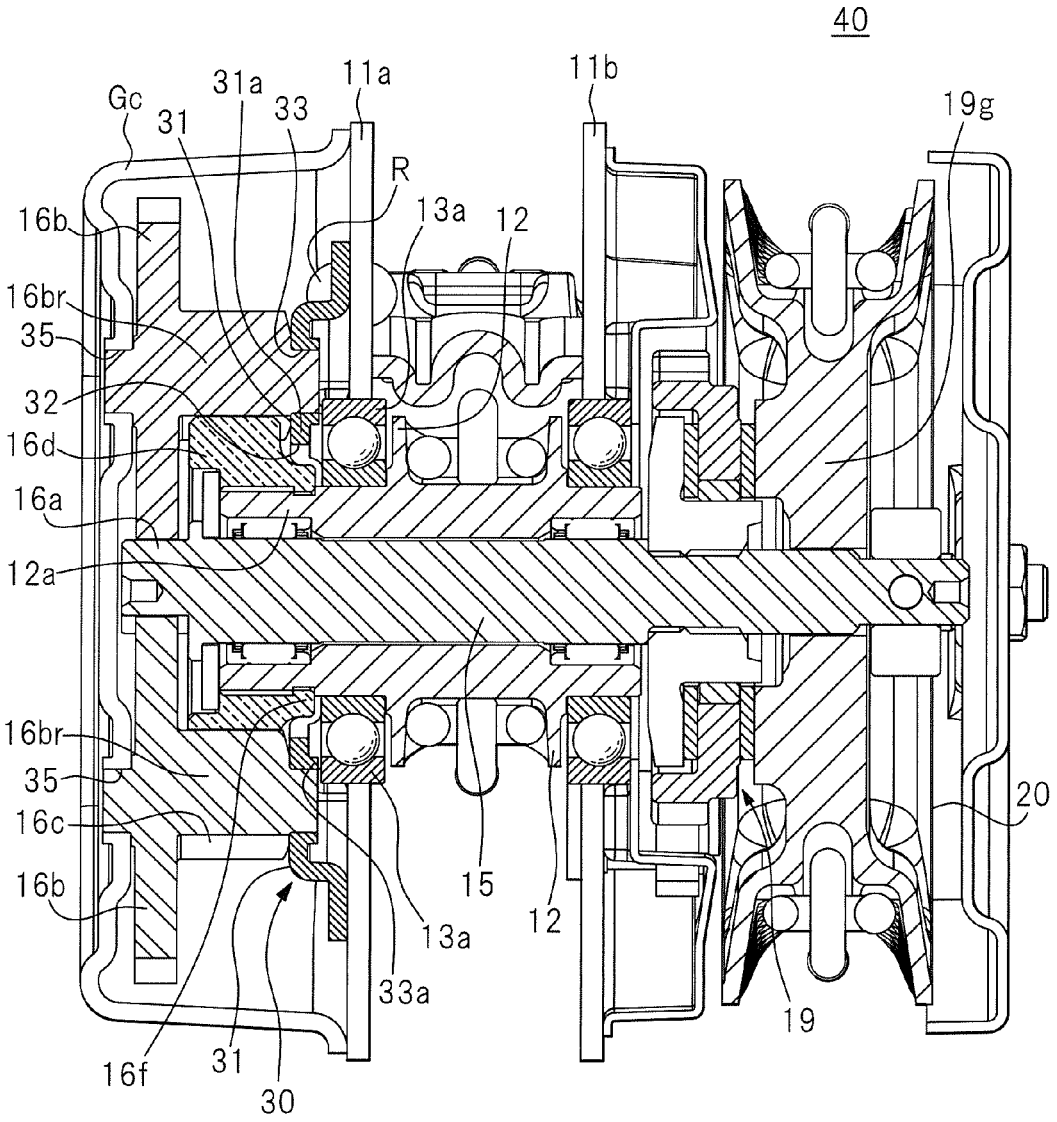
FIG. 5 is a longitudinal sectional view showing a manual chain block according to a second embodiment of the present invention.
Figure 6:
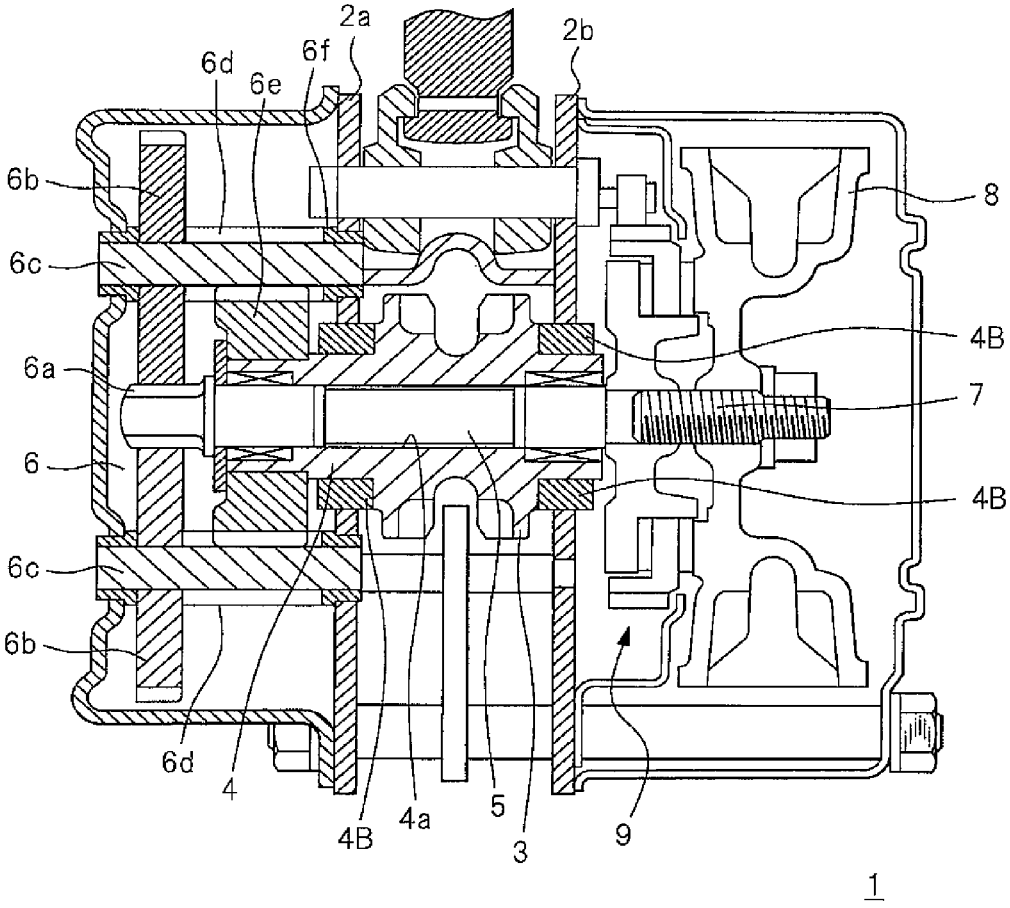
Fig.6 PRIOR ART
FIG. 6 is a longitudinal sectional view showing an example of known manual chain block.

FIG. 5 shows a manual chain block 40 according to a second embodiment. The manual chain block 40 according to the present embodiment basically has a configuration similar to that of the manual chain block 10 according to the first embodiment. Accordingly, substantially the same elements are denoted by the same reference numerals, and explanation thereon will be omitted.

In this manual chain block 40, in order to allow the shaft of the reduction gears to be located close to the center, or in order to allow a bearing (ball bearing) 13*a* having a large diameter to be used, the auxiliary plate 30 is not situated around the outer periphery of the bearing 13*a* for supporting the shaft portion 12*a* of the load sheave 12, but extends between the toothed portion of the load gear 16*d* and the bearing 13*a*, and therefore closer to the shaft portion 12*a* of the load sheave 12.

In the manual chain block 40, too, the axial end on the left end side of the first reduction gear 16*b* of the reduction gear mechanism 16 is rotatably supported in the bearing hole 35 formed in the gear cover Gc, while the right end side of the shaft portion 16*br* is rotatably supported in the bearing hole 33 of the auxiliary plate 30.

In this case, the bearing hole 33 of the auxiliary plate 30 is close to the bearing 13*a* of the first main frame 11*a* in the radial direction, and the tubular portion 33*a* of the bearing hole 33 situated near the center is positioned so as to come in contact with the side surface of the bearing 13*a*.

With the above configuration and arrangement, force in a thrust direction exerted onto the bearing 13*a* for supporting the shaft portion 12*a* of the load sheave 12 can be borne by the tubular portion 33*a* of the bearing hole 33 of the auxiliary plate 30 situated closer to the center.

If the outer diameter of the bearing 13*a* is smaller relative to the position where the tubular portion 33*a* is provided, a bottom annular portion 31*a* of the draw portion 31 around the inner periphery of the center hole 32, rather than the tubular portion 33*a*, may also come in contact with the side surface of the bearing 13*a*.

In accordance with the manual chain block 40 as described above, not only can the shaft of the reduction gear be positioned closer to the center, but also the force in a thrust direction exerted onto the bearing 13*a* for supporting the shaft portion 12*a* of the load sheave 12 can be borne by the tubular portion 33*a* of the bearing hole 33 of the auxiliary plate 30 situated closer to the center, or by the annular portion 31*a* around the inner periphery of the center hole 32.

Also, the force exerted from the load sheave 12 onto the bearing 13*a* in a thrust direction can be borne by the portion of the auxiliary plate 30 extending between the toothed portion of the load gear 16*d* of the auxiliary plate 30 and the bearing 13*a*. Accordingly, the stop ring 13*r* provided on the bearing 13*a* for supporting force exerted from the load sheave 12 in a thrust direction can be dispensed with.

Although the present invention has been described above with reference to particular embodiments, it will be apparent to those skilled in the art that various modifications or alterations can be made without departing from the scope and spirit of the invention.

LIST OF REFERENTIAL NUMERALS

10 manual chain block
11*a* first main frame
11*ah* insertion hole
11*b* second main frame
12 load sheave
12*a*, 12*b* shaft portion
12*c* through hole
13*a*, 13*b* bearing
13*r* stop ring
14*a*, 14*b* needle bearing
15 drive shaft
15*a* flange portion
16 reduction gear mechanism
16*a* pinion gear
16*b* first reduction gear
16*br* shaft portion
16*c* second reduction gear
16*d* load gear
16*f* boss portion
17 stud bolt
18 upper hook
19 mechanical brake
19*a* driven member
19*b* brake member
19*c* bush
19*d* ratchet gear
19*e* torsion spring
19*f* claw member
20 hand wheel
30 auxiliary plate
31 draw portion
31*a* bottom annular portion
32 center hole
33 bearing hole
33*a* tubular portion
34 fixing hole
35 bearing hole
40 manual chain block
Gc gear cover
Hc wheel cover
W washer
R rivet
Ct cover end plate

What is claimed is:

1. A manual chain block comprising:

a drive shaft capable of rotating in response to a manual operational force;

a load sheave around which a load chain is looped, the load sheave being mounted coaxially to the drive shaft, supported together with the drive shaft on a frame via a bearing, and coupled to the drive shaft so that mechanical power is transmitted therebetween, via a reduction gear mechanism, wherein the reduction gear mechanism includes a pinion gear provided on the drive shaft, reduction gears which mesh with the pinion gear, and a load gear interlocked with the load sheave and meshed with the reduction gears;

a gear cover which houses the reduction gear mechanism and includes a first bearing hole to support the reduction gear mechanism at one end of the reduction gear mechanism and serve as a bearing for the reduction gear mechanism; and an auxiliary plate mounted on a side surface of the frame and in the periphery of the bearing for the load sheave, the auxiliary plate including a first portion on which the auxiliary plate is mounted on the side surface of the frame, a second portion extending from the first portion and spaced apart from the side surface of the frame, and a third portion extending from the second portion toward the side surface of the frame, the third portion including a second bearing hole extending in a thrust direction of the bearing for the load sheave, wherein the second bearing hole supports the reduction gear mechanism at another end of the reduction gear mechanism and serves as a bearing for the reduction gear mechanism, wherein the frame includes an insertion hole through which the load sheave and the drive shaft extend, wherein the second portion includes a center hole spaced apart from the insertion hole in the thrust direction, and wherein the insertion hole and the center hole support the bearing for the load sheave.

2. The manual chain block according to claim 1, wherein the third portion of the auxiliary plate is in contact with the side surface of the frame.

3. The manual chain block according to claim 1, wherein the second portion of the auxiliary plate has a flat rhombus shape with rounded corners.

4. The manual chain block according to claim 1, wherein the second bearing hole is formed in a tubular portion projecting toward the frame.

5. The manual chain block according to claim 4, further comprising a fixing hole to accommodate a rivet to fix the auxiliary plate to the frame, the fixing hole being formed in the first portion.

* * * * *